United States Patent [19]

Fowler et al.

[11] Patent Number: 4,541,341

[45] Date of Patent: Sep. 17, 1985

[54] SELF-CHECKING ARMING AND FIRING CONTROLLER

[75] Inventors: Steven E. Fowler; George N. Hennings; James V. McVay, all of Ridgecrest, Calif.

[73] Assignee: The United States of America as represented by the Secretary of the Navy, Washington, D.C.

[21] Appl. No.: 546,630

[22] Filed: Oct. 28, 1983

[51] Int. Cl.[4] ..... F42C 15/40

[52] U.S. Cl. ..... 102/215

[58] Field of Search ..... 102/215, 221, 265, 270

[56] References Cited

U.S. PATENT DOCUMENTS

| | | | |
|---|---|---|---|
| 2,980,020 | 4/1961 | Smith | 102/70.2 |
| 3,667,392 | 6/1972 | Grantham et al. | 102/70.2 |
| 3,750,583 | 8/1973 | White et al. | 102/70.2 |
| 3,888,181 | 6/1975 | Kups | 102/70.2 |
| 4,089,268 | 5/1978 | Jaroska et al. | 102/70.2 |
| 4,160,417 | 7/1979 | Fowler | 102/221 |
| 4,424,745 | 1/1984 | Magorian et al. | 102/215 |

*Primary Examiner*—Charles T. Jordan

*Attorney, Agent, or Firm*—Robert F. Beers; W. Thom Skeer

[57] ABSTRACT

A munition fuze electronic arming and firing controller includes a microprocessor and logic network which verify controller operation and provide an enabling signal necessary to arm the fuze. A signal of predetermined duration is twice produced by the microprocessor and is utilized with a clock signal continuously produced in the logic network to cause a counter to count during two separate periods. The resulting counter count is checked by verifying logic which outputs a signal only if the count is a predetermined count after each counting period. If the counter output is twice verified and an energy storage component external to the controller is charged to less than a predetermined minimum the logic network outputs an enabling signal which triggers the microprocessor to produce drive signals utilized to arm the fuze by charging the energy storage device. User selected inputs and firing sensor initiated inputs initiate munition detonation at a predetermined time and under predetermined conditions.

11 Claims, 3 Drawing Figures

SELF-CHECKING ARMING AND FIRING CONTROLLER

BACKGROUND OF THE INVENTION

1. Field of the Invention

The present invention releates to munition systems in which control of the detonation process is critical and in which weapon detonation must occur only at desired times with an extremely high degree of reliability. More specifically the present invention relates to an electronic arming and firing device which meets or exceeds the safety criteria established for "out-of-line" fuze systems.

2. Description of the Prior Art

An "out-of-line" explosive train is one in which the primary explosives are physically separated from the output lead and booster explosives to prevent the detonation of a warhead or other main explosive charge until after the arming process has occurred. Separation of explosive train components in "out-of-line" systems is accomplished by interposing a physical barrier between explosive train components or by maintaining explosive train components physically misaligned so as to be uncommunicative until after the arming process is completed. When the arming process is complete explosive train components are "in-line" and initiation of any explosive train component will result in detonation of the main charge. Theoretically and preferably explosive train components are initiated in a predetermined sequence after arming has occurred.

"Out-of-line fuzing" is the currently accepted method of munition fuzing to the virtual exclusion of use of "in-line" fuze systems. The use of "out-of-line" fuzing schemes has been mandated by safety considerations which are traceable primarily to what was heretofore the necessity of using a sensitive detonator to initiate the explosive train. The necessity of using a relatively sensitive detonator dictated the physical separation of explosive train components to ensure that accidental initiation of the detonator would not ultimately lead to an untimely munition detonation.

Current art "out-of-line" fuzes are essentially mechanical in nature although some fuzes utilize electronics to accomplish certain timing functions. Present fuze systems utilize electronic or mechanical timers to control movement of the explosive train from an "out-of-line" to an "in-line" condition.

While current "out-of-line" fuzes have proven effective, it has been determined that there is a need to improve overall fuze system reliability. Particularly, advances in the electronics art and in the design of less sensitive warhead initiators have focused attention on the advantages of "in-line" fuzing over "out-of-line" fuze systems. These advantages are not insignificant. First, current "out-of-line" devices are more prone to breakdown of a mechanical nature than current electronic devices are prone to electronic malfunction and the reliability of electronic components has become an accepted fact.

Second, current devices which utilize mechanical, electromechanical and pyrotechnic components are becoming increasingly costly while the cost of electronic components has steadily fallen. Further, much of the mechanical fuze technology and manufacturing capability, which has historically been intertwined with mechanical watch movement technology and production is disappearing, making certain critical mechanical components difficult and expensive to procure.

Third, current fuzes which do utilize electronics are capable of being improved upon in several areas. One particular area requiring improvement is in the area of the power and logic interface between a munition and the platform which carries and releases it. Interface disruption has been known to occur during the munition release process resulting in improper logic and/or power transfer to the munition and the faulty functioning or nonfunctioning of the munition fuze.

Fourth, many current fuze designs utilize "one-shot" or single event pyrotechnic components in the arming sequence. The use of such components whether in the arming device itself or elsewhere in the fuze results in the inability to nondestructively test the fuze system. A necessarily less reliable fuze results when compared to a device capable of being nondestructively tested.

Finally, the arming process of many current fuze systems relies at some point on stored energy. The use of stored energy in any phase of the arming process is to be avoided if possible in that its inadvertent release necessarily results in a less safe and likely a dudded munition.

Before the development of the device of the present invention there had not been any electronic arming and firing device with the safety and reliability necessary for the acceptance of use of an "in-line" fuzing system.

SUMMARY OF THE INVENTION

Briefly, the present invention is an electronic device for use in a munition fuze which controls the fuze arming and firing process.

The device of the present invention is divisible into two essential sections. The first section, a timed signal generating section, (1) receives user initiated inputs which determine the mode and timing of fuze operation, (2) monitors the status of the electrical charge of an energy storage component in the fuze utilized to fire the warhead initiator, (3) provides the signals necessary to charge the energy storage component and (4) generates a firing signal when the appropriate user selected sensors indicate warhead detonation should occur.

The second section, a self-check circuit, monitors the operation of the timed signal generating section and provides the signal generating section with an enabling signal only if satisfied that the operation of the timed signal generating section is correct. The enabling signal is provided by the self-check circuit only after precise and rigorous timing checks have been satisfactorily completed. The failure of any of a number of checked signals to occur at the correct time and in the correct sequence will prevent the charging of the fuze energy storage device with the power necessary to initiate munition detonation.

The device of the present invention utilizes no moving mechanical components, relying instead upon readily available electronic components. Further, the device does not require the degree of interface with or input from the munition releasing platform required by many current devices. The arming and firing device of the present invention is a more independent component making the fuze system in which it is utilized less susceptible to failure due to platform interface disruption. Operation of the device of the present invention can be bench tested to ensure it is properly functioning prior to its use in a munition. The device of the present invention does not rely on stored energy and is compatible with fuze designs which utilize the post munition release environment for generating the energy necessary for fuze system operation.

It is an object of the present invention to electronically control the arming and firing of a munition in a reliable and safe manner.

It is another object of the present invention to reliably and safely control the arming and firing of a munition where the mechanism for controlling the arming process is self-checking.

A further object of this invention is to electronically control the arming and firing process in a munition fuze in a manner demonstrably reliable and safe enough to permit the use of "in-line" fuzing schemes in munitions applications.

These and other objects and advantages of the present invention will be apparent when the following description of an exemplary embodiment of the present invention is examined in conjunction with the accompanying drawings.

DESCRIPTION OF THE PREFERRED EMBODIMENT

Figure 1:
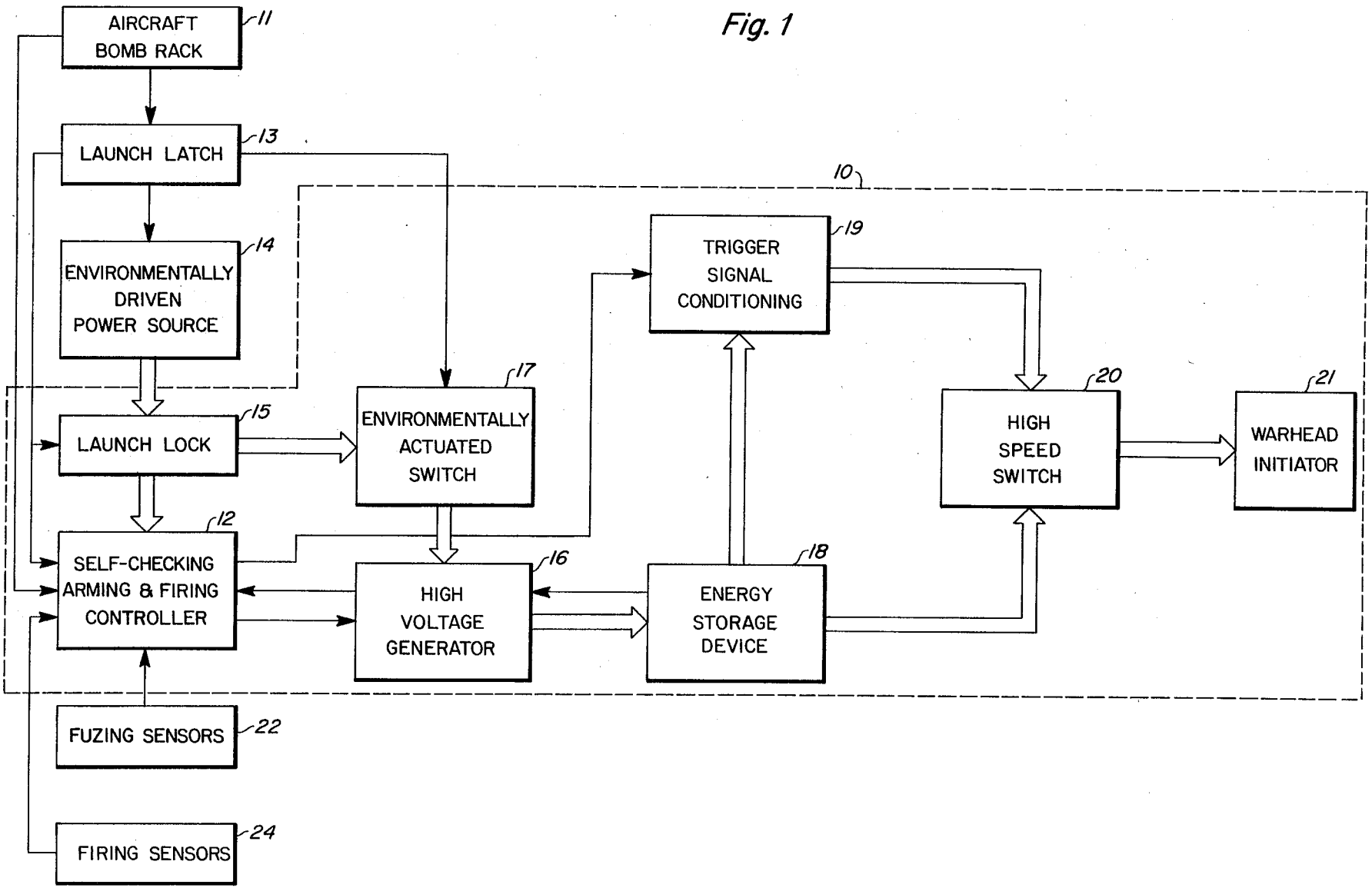
FIG. 1 is a block diagram of a typical "in-line" fuze system utilizing the arming and firing controller of the present invention.

Referring to FIG. 1 a block diagram demonstrating the components of a typical "in-line" munition fuze configuration, such as might be utilized in an aircraft released bomb, is shown. The fuze of FIG. 1 is configured to utilize the controller of the present invention and the operational relationships of the fuze components are demonstrated.

User initiated fuze timing and mode selection is communicated to fuze 10 through bomb rack 11 of an aircraft. This information is provided directly to arming and firing controller 12, the device of the present invention. Launch latch 13 is an actuating device, of which many variations, such as tear-away tabs, are known in the art. Launch latch 13 signals the release of the munition from the carrying aircraft to various fuze components including arming and firing controller 12. Environmentally driven power source 14 derives power from the post weapon release weapon environment for the operation of fuze 10. Launch lock 15 is a mechanical or electrical timing safety device which will dud fuze 10 by interrupting power from environmentally driven power source 14 to arming and firing controller 12 if sufficient voltage from environmentally driven power source 14 is not sensed within a predetermined time after launch latch 13 signals the release of the munition from the aircraft.

High voltage generator 16 arms fuze 10 by converting low voltage drive signals received at a predetermined time from arming and firing controller 12 into high voltage signals utilizing power provided by environmentally driven power source 14. Before the environmentally generated power is capable of being utilized, an environmentally actuated switch must be in an enable condition. Switch 17 is a safety component which functions to interrupt any power output from high voltage generator 16 until release of the munition from the munition carrying aircraft is sensed. Switch 17 will normally be a mechanical lanyard actuated switch.

High voltage energy produced by generator 16 utilizing the signals produced by arming and firing controller 12 is stored in energy storage device 18. When storage device 18 is charged to a predetermined level the munition is armed. Energy storage device 18 is preferably a low inductance capacitor capable of delivering energy at a high rate of discharge over a short period of time.

Arming and firing controller 12 performs a series of fuzing checks and provides a firing signal upon satisfactory completion of these checks which triggers the munition detonation process. The firing signal is produced and delivered to trigger signal conditioner 19, a circuit which operates on the low voltage firing signal received from controller 12 to make it compatible for use with high speed switch 20. High speed switch 20, which is a high current device, causes the release and controls the flow of energy from energy storage device 18 upon receipt of the firing signal originated by controller 12. The energy released through high speed switch 20 is delivered to warhead initiator 21. Warhead initiator 21 is preferably a slapper detonator although an exploding bridge wire detonator may be satisfactorily utilized. Both types of detonators are well known in the art and utilize only secondary explosives which are much less sensitive than the primary explosives utilized in current "out-of-line" fuze systems.

Fuzing sensors 22, many of which can be envisioned, provide inputs to arming and firing controller 12 based upon the environment in which the fuze operates. These sensors provide go-no go signals which must be present before the fuze arming process can occur. Sensors contemplated for use include pressure sensors and deceleration sensors. A deceleration sensor would allow arming and firing controller 12 to arm fuze 10 earlier than the time selected by the user. This feature would be useful in munitions slowed by deployment of a parachute or other braking mechanism, such as extendable flaps. Safe separation from the aircraft prior to munition arming would be assured while the advantages of early arming would be achieved. The pressure sensor is contemplated to perform a safety function by detecting a post munition release environment. Until a post munition release environment is detected arming and firing controller 12 would be inhibited by the input of the pressure sensor from arming the munition fuze.

Firing signal initiation sensors 24 provide the required stimulus to cause arming and firing controller 12 to produce a firing signal. These sensors include proximity and contact sensors well known in the art. The proximity sensor produces a signal when predetermined criteria are met indicating the immediacy of a target or object having characteristics similar to an expected target. The contact sensor produces a signal when munition deceleration or deformation indicates impact with an object.

Figure 2:
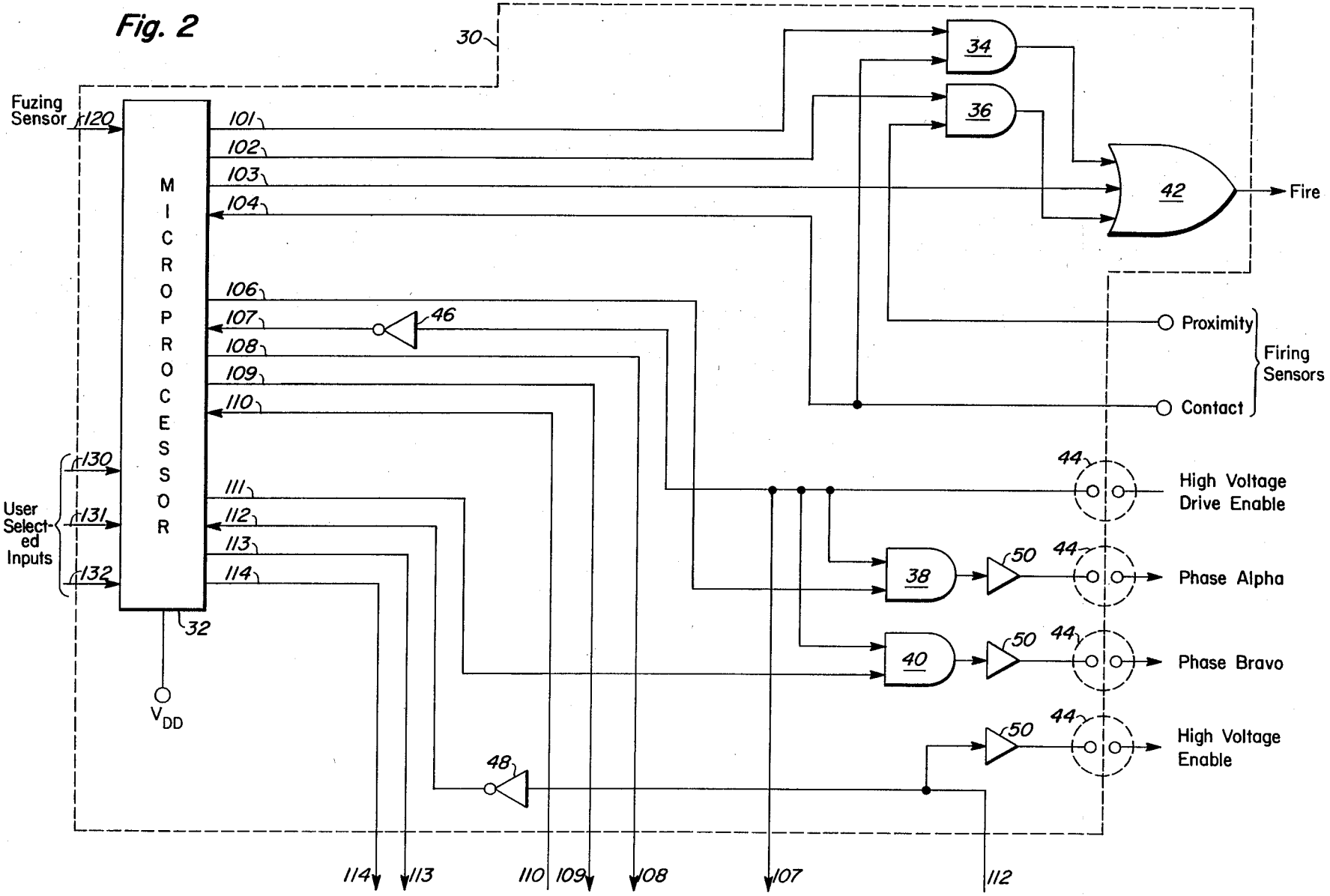
FIG. 2 is a schematic diagram of the electronic arming and firing controller of the present invention.
Figure 2:
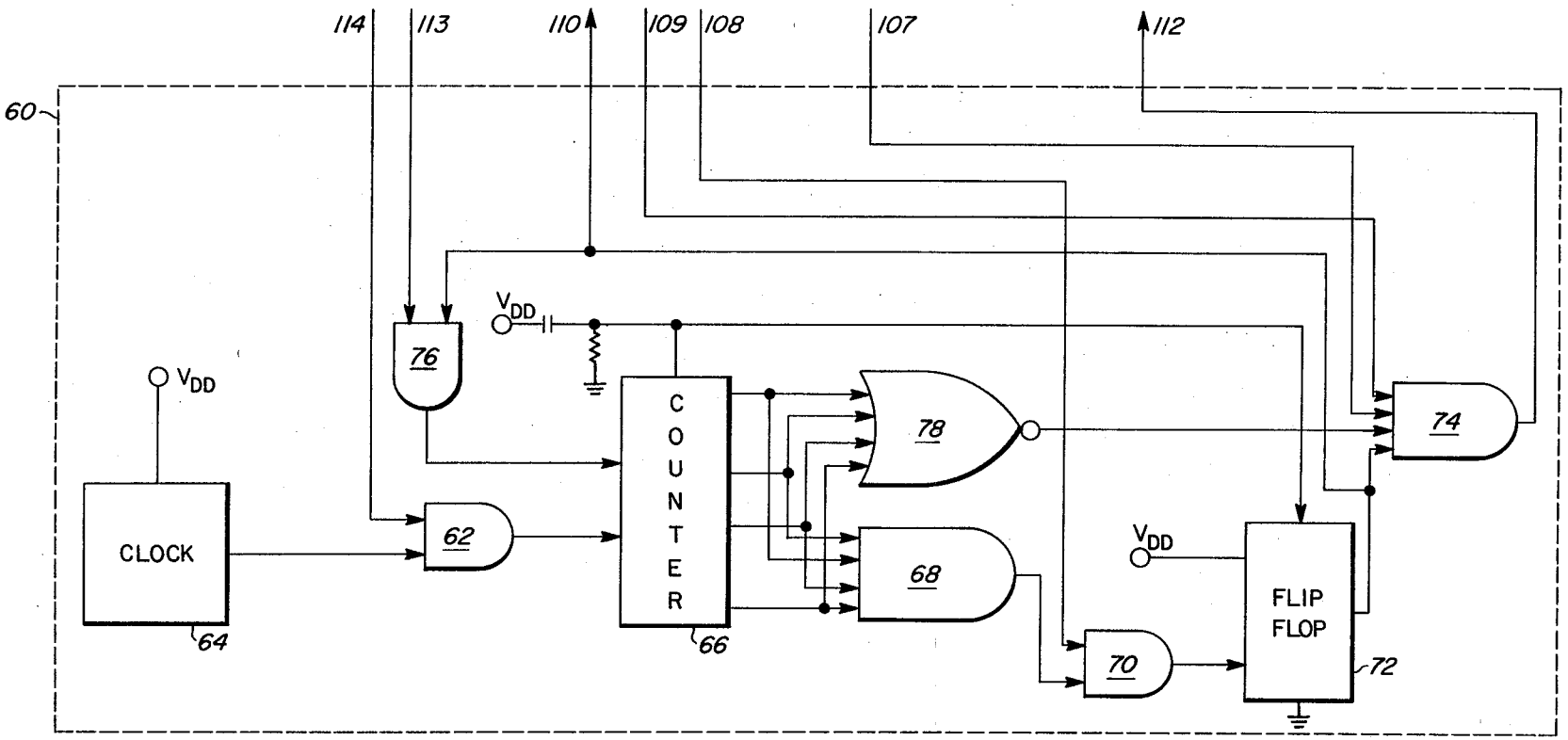

Referring to FIG. 2 the components of arming and firing controller 12 are illustrated. Arming and firing controller 12 is divided into the two distinct sections previously mentioned. Timed signal generating section 30 includes microprocessor 32 which provides signals at times predetermined by initial user input and based upon the running of an internal microprocessor clock. Timed signal generating section 30 also includes arming logic and firing logic circuitry the particular operation of which is likewise predetermined by pre-munition release user selected input. Self-check circuit 60 includes a clock independent of the clock in microprocessor 32. Comparative logic circuitry in self-check circuit 60 ensures that timed signal generating section 30 will not output the signals necessary to initiate munition detonation nor allow arming to occur unless rigorous timing checks have been satisfied.

An understanding of the device of the present invention is best accomplished by examining its operation as utilized in an aircraft released bomb fuze. The operation as described presumes user selection of the contact sensor to initiate munition detonation as well as selection of the instantaneous detonation mode. Further, it will be presumed that the energy storage device, once charged, does not require recharging prior to munition detonation.

Figure 3:
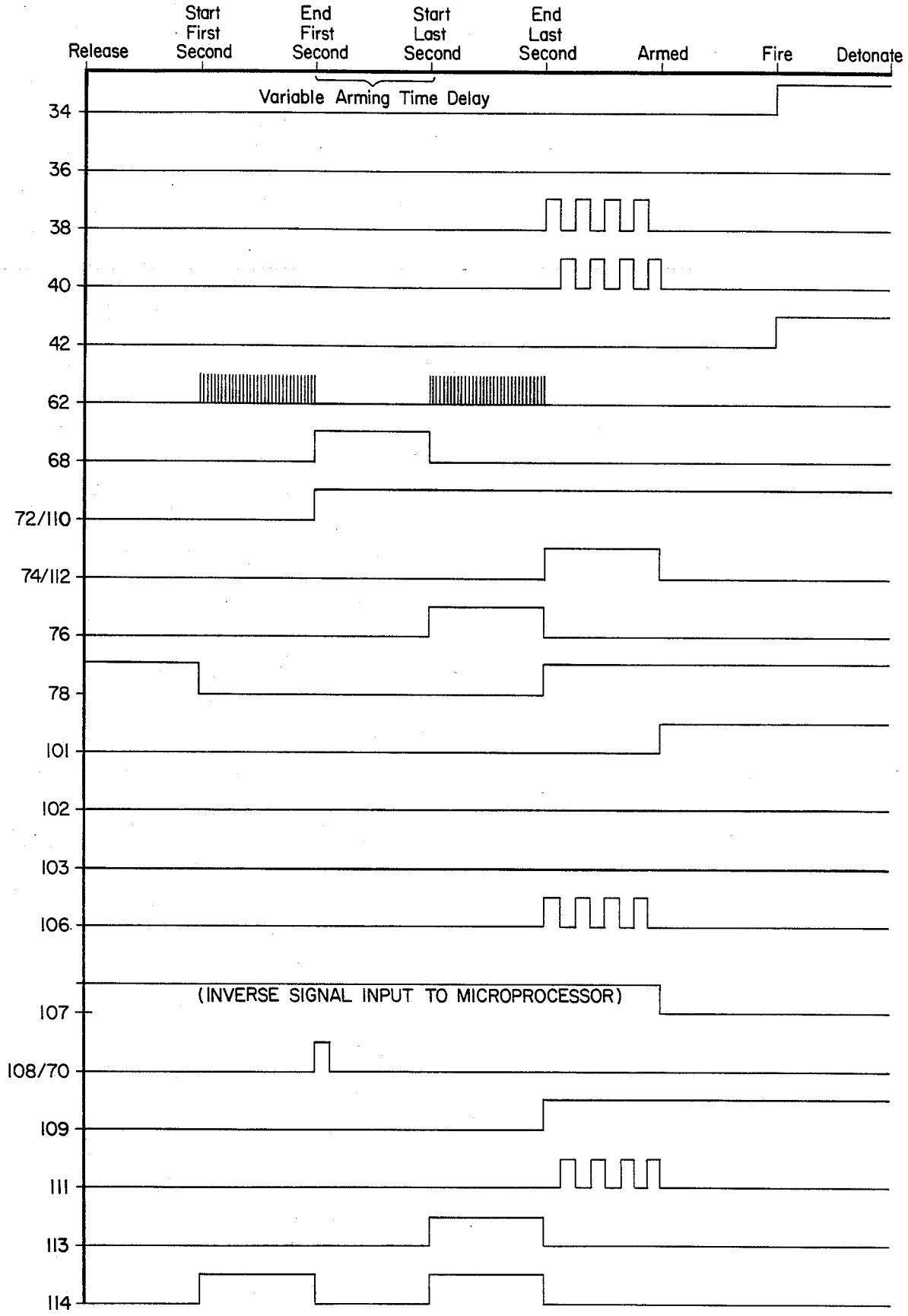
FIG. 3 is a timing diagram of the state of relevant signals and component outputs in the arming and firing controller of the present invention for the instance in which the user has selected the contact sensor to initiate instantaneous firing of the warhead detonator and wherein the energy storage device of the fuze does not require recharging prior to munition detonation.

Prior to release of the munition from the carrying aircraft the munition user selects a fuzing mode, an arming interval and, if appropriate, a detonation delay period. Referring now to FIGS. 1, 2 and 3 concurrently, user selected inputs are communicated to microprocessor 32 of arming and firing controller 12 via bomb rack 11 of the aircraft. Input lines 130, 131 and 132 into microprocessor 32 represent input paths for user mode and timing selections. Upon release of the munition from the aircraft, microprocessor 32 receives an enabling signal from an external pressure sensor on sensor input line 120. Until this enabling signal is received, indicating the existence of a post munition release environment, microprocessor 32 is inhibited from operating. If munition release is satisfactorily accomplished, controller 12 is enabled to operate and will receive operational power from environmentally driven power source 14 through launch lock 15. When arming and firing controller 12 receives a power "on" signal indicating that munition drop or launch has successfully been accomplished, all logic flip-flops in controller 12 are cleared. The power "on" signal is indicated in FIG. 2 as $V_{DD}$.

Referring now primarily to FIGS. 1 and 2, microprocessor 32 monitors the state of electrical charge of energy storage device 18 via a signal received from high voltage generator 16 on high voltage drive enable line 107. Whenever the state of charge of storage device 18 is below a predetermined minimum the signal received from high voltage generator 16 will be a logic ONE. However, due to the insertion of inverter 46 in high voltage drive enable line 107, microprocessor 32 will monitor a logic ZERO whenever energy storage device 18 is in need of charge while the remainder of line 107 contains a ONE signal. Microprocessor 32 should monitor a logic ZERO on line 107 until fuze 10 is armed, arming being accomplished by the charging of energy storage device 18. If microprocessor 32 untimely receives a ONE signal input on high voltage drive enable line 107 such as at initial power-up, microprocessor 32 will be disabled from producing any subsequent output signals. A premature ONE signal input into microprocessor 32 on drive enable line 107 is indicative of premature fuze arming or malfunction and will result in the dudding of the munition.

Once microprocessor 32 is enabled to operate due to the occurrence of satisfactory munition release and receives the signal indicating that energy storage device 18 is uncharged the arming sequence commences.

At the beginning of the first second of the arming sequence microprocessor 32 outputs a logic ONE signal on time sample out line 114. This signal provides one enabling input to AND gate 62 in self-check circuit 60. Clock 64 of self-check circuit 60, which begins producing clock signals consisting of a series of logic ONES and ZEROS at a predetermined frequency upon receipt of the $V_{DD}$ signal, provides a second enabling input to AND gate 62. When the output of AND gate 62 becomes a time varying logic ONE/ZERO signal in response to receipt of the two above-mentioned enabling inputs, up-down counter 66 begins counting up. AND gate 62 can therefore be considered to be counter enabling gate means. The frequency of clock 64 is such that the outputs of up-down counter 66, initially all ZEROS, will proceed from all ZEROS to all ONES in precisely one second. The ONE signal on time sample out line 114 from microprocessor 32 lasts for precisely one second, based upon the timing of the microprocessor clock, at which time it returns to ZERO. As a result, after one second, based upon the clock of microprocessor 32, the output of AND gate 62 goes to ZERO and counter 66 discontinues counting up.

At the end of the first second all of the outputs from counter 66 should be ONES if the arming sequence and timing are proceeding properly. If the outputs of up-down counter 66 are all ONES, AND gate 68 will output a logic ONE signal providing initial verification of controller operation and providing an enabling input into AND gate 70. AND gate 68 is thus seen to be logic means for verifying the output of controller 66. The second input to AND gate 70 is a ONE signal provided by microprocessor 32 on first second check line 108 which, in conjunction with a logic ONE output from AND gate 68, enables AND gate 70 to output a ONE signal. The ONE signal provided by microprocessor 32 to AND gate 70 is timed to occur immediately upon completion of the first second of the arming sequence and is of short duration. The brevity, on the order of 50 milliseconds, and timing of this signal acts as a check on controller operation. Counter 66 must be outputting all ONE signals, enabling AND gate 68 to output a ONE signal, at the same point in time microprocessor 32 outputs the short ONE pulse on first second check line 108 or the munition will be dudded for failure of AND gate 70 to produce a ONE signal for input to flip-flop 72. AND gate 70 thus comprises means for transmitting the initial verification signal from AND gate 68.

The ONE signal output from AND gate 70 is clocked into flip-flop 72 which in turn provides one of four ONE signals necessary to enable AND gate 74. The level of the signal output by flip-flop 72 will remain unchanged irrespective of an initial change in the output of AND gate 70. In addition to providing an enabling ONE signal to AND gate 74 the ONE signal from flip-flop 72 is routed to microprocessor 32 on flip-flop check line 110 as an indication to microprocessor 32 that the first second check was successfully completed. Failure of this signal to be received in microprocessor 32 will result in a dudded fuze in that receipt of this signal is necessary to enable microprocessor 32 to later produce the drive signals necessary to charge energy storage device 18. The ONE signal from flip-flop 72 is additionally routed to AND gate 76 of self-check circuit 60 where it acts as one of the two enabling inputs required before an additional timing check can occur.

After one second, all first second logic checks of the arming sequence and timing have been completed and an arming time delay phase is entered. The arming time delay phase is a user selected time period of variable length during which a safe separation distance between the released munition and the releasing aircraft is achieved. During this phase microprocessor 32 monitors the output of AND gate 74 utilizing enable check line 112 to ensure that the output of AND gate 74 has remained a logic ZERO. If the output of AND gate 74 is a logic ZERO, the signal received by microprocessor 32 will be a ONE due to the inclusion of inverter 48 in high voltage enable line 112. If the output of AND gate 74 is not ZERO or changes from a ZERO to a ONE during this period microprocessor 32 is disabled from outputting subsequent signals necessary for fuze arming and the munition is dudded. During the arming time delay phase the internal clock of microprocessor 32 counts down the user selected time delay. When the user selected time delay has run, a last second check on the arming sequence and timing occurs.

At the beginning of the last second before arming microprocessor 32 supplies a ONE signal to AND gate 76 on last second start line 113. This signal enables AND gate 76 to output a ONE since the second input to AND gate 76, originated by flip-flop 72 is a ONE. The ONE signal output from AND gate 76 switches up-down counter 66 from the up-count mode to the down-count mode, AND gate 76 being means for switching the operational mode of counter 66. Concurrently, microprocessor 32 imposes a ONE signal on time sample out line 114 for a period of precisely one second, based upon microprocessor clock timing, enabling AND gate 62 to produce a time varying ONE/ZERO signal which causes up-down counter 66 to count down for one second. During this one second period the output from up-down counter 66 will change from all ONES to all ZEROS if fuze timing elements are functioning properly. At the end of this one second last second check period the signal on time sample out line 114 is returned to ZERO by microprocessor 32 causing the output of AND gate 62 to return to ZERO and causing up-down counter 66 to stop counting. If the outputs of up-down counter 66 are all ZERO a second verification of controller operation is accomplished and NOR gate 78 will produce a ONE signal. NOR gate 78, like AND gate 68, is thus seen to be logic means for verifying the output of counter 66.

The ONE signal from NOR gate 78 is the second of four required ONE signals necessary before AND gate 74 can produce a logic ONE high voltage enable signal on line 112. The third enabling ONE signal required by AND gate 74 is received on high voltage drive enable line 107. Although microprocessor 32 will be monitoring a ZERO on line 107 due to the existence of inverter 46 in line 107, the remainder of high voltage drive enable line 107 will be carrying a ONE signal since energy storage device 18 should, at this point, remain uncharged.

If all checks have proceeded satisfactorily microprocessor 32 will impose a ONE signal on last second check line 109. This signal is the last of the four signals required before AND gate 74 can produce the high voltage enable ONE signal on line 112. AND gate 74 is but one logic component or combination of logic components which can function as high voltage enabling logic means.

When a logic ONE signal is imposed on high voltage enable line 112 by AND gate 74 the signal monitored by microprocessor 32 on line 112 out of inverter 48 will go to ZERO. This causes microprocessor 32 to produce drive pulse train signals on phase ALPHA line 106 and on phase BRAVO line 111. These signals are square wave pulse trains of opposite polarity consisting of a series of logic ONES and ZEROS occurring at a predetermined frequency such as 5 KHz. The signal on line 106 comprises a first input into AND gate 38 while the signal on line 111 comprises a first input into AND gate 40. The second input into each of AND gates 38 and 40 is the signal on high voltage drive enable line 107 as received from high voltage generator 16 and which is a logic ONE until energy storage device 18 is charged to a predetermined level. Whiie the pulse trains of opposite polarity are imposed by microprocessor 32 on lines 106 and 111, the output of AND gates 38 and 40 will be drive signals identical to the particular pulse train input to them. As a result, whenever AND gate 74 outputs a ONE and AND gates 38 and 40 are producing drive signals based upon the pulse trains received from microprocessor 32, voltage generator 16 is enabled and driven to produce the power necessary to charge energy storage device 18. It is apparent from the foregoing that AND gates 38 and 40 are drive signal producing logic means.

When energy storage device 18 is fully charged the signal on high voltage drive enable line 107 goes to ZERO disabling AND gate 74 from producing a ONE signal on high voltage enable line 112. The change in state of the signal on high voltage drive enable line 107 results in and is sensed as a change of state on line 112 by microprocessor 32 which discontinues producing the drive signals on phase ALPHA line 106 and phase BRAVO line 111. At this point the fuze is armed by virtue of the fact that the energy storage device is fully charged. Microprocessor 32 continues to monitor the state of charge of energy storage device 18 by monitoring the status of the signal on high voltage drive enable line 107. If the state of charge of energy storage device 18 falls below a predetermined minimum the signal on high voltage drive enable line 107 will return to ONE which will enable microprocessor 32 and self-check circuit 60 to produce the signals necessary to recharge the energy storage device to the predetermined minimum level.

With the exception of energy storage device monitoring, once fuze 10 is armed nothing occurs within arming and firing controller 12 until detonation of the munition is signaled. As noted, firing sensors such as proximity and contact sensors will be installed in the munition. In the fuzing sequence selected to be described, presumption was made that munition detonation should be initiated instantaneously upon target impact. In this scenario microprocessor 32 will have imposed a ONE signal on instantaneous fire line 101 upon completion of the arming time delay phase in response to the user selected instantaneous fire input. This signal is imposed on line 101 after the signal input to microprocessor 32 on line 107 changes state due to the charging of energy storage device 18. The ONE signal on instantaneous fire line 101 comprises one input into AND gate 34. When target impact is sensed by the contact sensor external to the fuze a ONE signal is imposed on line 104 which is provided to both microprocessor 32 and AND gate 34. As a result, AND gate 34 outputs a ONE signal which futher enables OR gate 42 to output the ONE signal which is the munition firing signal. If the user had selected to delay the detonation of the munition until some time after munition impact the signal out of microprocessor 32 on instantaneous fire line 101 would have remained ZERO while the signal out of microprocessor 32 on delay fire line 103 would have become a ONE after microprocessor 32 had counted down the user selected delay time after target impact was sensed on line 104.

If the user had selected to use the proximity sensor to initiate the generation of the firing signal microprocessor 32 would have imposed a ONE signal in proximity fire line 102 providing one of the two necessary enabling inputs to AND gate 36. The second enabling input into AND gate 36 would then have been generated by the external proximity sensor. When both enabling signals into AND gate 36 became ONES, AND gate 36 would output a ONE signal causing OR gate 42 to produce the firing signal. It can be seen that gates 34, 36 and 42 are logic means for producing a firing signal in response to inputs from microprocessor 32 and from one of the firing sensors external to fuze 10.

The above-described embodiment was successfully built and tested utilizing an Intel Model No. 8478 microprocessor. Further, in the embodiment successfully built and tested arming and firing controller 12 was connected via optical couplers 44 to high voltage generator 16 in order to protect microprocessor 32 from any high voltage transients. That is, the logic signal on high voltage enable line 112 produced by AND gate 74 was communicated to the high voltage generator via optical coupling. Likewise the drive signals output from AND gates 38 and 40 were optically communicated to the high voltage generator. In the same manner, the status of electrical charge of energy storage device 18 was monitored by microprocessor 32 via high voltage generator 16 through an optical coupler. Buffers 50 provided the current necessary to drive optical couplers 44.

In describing the use of the arming and firing controller reference has been made to aircraft released munitions. The invention is clearly not limited to such employment and could be utilized in virtually any munition fuze application whether "in-line" or "out-of-line". The particular make-up of the self-check circuit and the logic circuitry of timed signal generator section 30 are matters of choice, the circuitry illustrated in FIG. 2 being the preferred circuitry.

The duration of the signals denominated first second check and last second check is arbitrary, one second durations being particularly convenient. The duration of the initial and last period checks might obviously be shortened or lengthened if deemed advantageous although modification of the self-check circuit would be required.

Microprocessor characteristics and operation are fully described in the manufacturer's catalogue and instruction manual for use of the product. Microprocessor operation can easily be implemented in accordance with the above description by persons skilled in the electronic arts having access to the manufacturer's documentation. Further, microprocessors other than the one specifically noted could be utilized by those skilled in the electronics art to implement the apparatus of the present invention without difficulty.

Obviously many modifications and variations of the present invention are possible in light of the above teachings. It must therefore be understood that within the scope of the appended claims the invention may be practiced otherwise than as specifically described.

We claim:

1. An electronic arming and firing controller for use in a munition fuze, where said fuze includes an electrically fired warhead detonator and a chargeable electrical energy storage device, and where a firing sensor external to said fuze provides a signal to initiate the detonation of said munition, comprising:

timed signal generating means, the mode of operation and timing of operation of said signal generating means predetermined by inputs selected by the user of said munition prior to employment of said munition, for monitoring the state of electrical charge of said energy storage device and for producing a first, a second and a third signal, said first signal being a high voltage enabling signal, said high voltage enabling signal being a first prerequisite before said energy storage device can be charged, said second signal being a drive signal, said drive signal being a second prerequisite before said energy storage device can be charged, and, said third signal being a firing signal, said firing signal produced in response to input from said firing sensor; and self-checking logic means, electrically connected to said timed signal generating means and including a pulse producing clock operating at a predetermined frequency, for providing verification of the proper operation of said controller, said self-checking logic means originating said high voltage enabling signal and routing said high voltage enabling signal to said timed signal generating means.

2. The arming and firing controller according to claim 1 wherein said timed signal generating means includes a microprocessor having an internal clock, said microprocessor receiving said user selected inputs, monitoring the state of electrical charge of said chargeable storage device, providing signals of predetermined duration at predetermined times to said self-checking logic means to facilitate said verification and producing a drive pulse train in response to receipt of said high voltage enabling signal originated in said self-checking logic means.

3. The arming and firing controller according to claim 2 wherein said self-checking logic means is an electronic self-check logic circuit which includes a counter electrically connected to counter enabling gate means, said counter enabling gate means electrically connected to said pulse producing clock and to said microprocessor, said counter enabling gate means receiving as inputs a fourth signal and a fifth signal and outputting a sixth signal, said fourth signal being a timed sample signal and one of said signals of predetermined duration produced at predetermined times by said microprocessor, said fifth signal being a pulse train produced by said pulse producing clock and said sixth signal being a counter enabling signal causing said counter to count for a period of time, said period of time equal to the duration of said fourth signal, the output count of said counter required to be a predetermined count after said counting period for verification of controller operation and before said self-check logic circuit is enabled to originate said high voltage enabling signal.

4. The arming and firing controller according to claim 3 wherein said counter is an up-down counter and wherein the proper operation of said controller is verified an initial time and a second time, said microprocessor producing said fourth signal an initial time and a second time and said counter counting for an initial period and a second period, said fourth signal produced said initial time upon proper release of said munition and said second time after a delay period, said delay period having a duration being selected by said munition user and input to said microprocessor prior to release of said munition, the output count of said counter required to be a first predetermined count after said first counting period for accomplishment of said initial verification and a second predetermined count after said second counting period for accomplishment of said second verification and before said self-check logic circuit is enabled to originate said high voltage enabling signal, said self-check logic circuit further comprising means for switching the mode of operation of said up-down counter.

5. The arming and firing controller according to claim 4 wherein said high voltage enabling signal originated in said self-check logic circuit is produced by high voltage enabling logic means, said enabling logic means receiving a plurality of input signals including a seventh signal, said seventh signal indicative of the accomplishment of said initial verification, an eighth signal, said eighth signal indicative of the accomplishment of said second verification, a ninth signal, said ninth signal indicative of the state of electrical charge of said energy storage device, and, a tenth signal, said tenth signal being a last period check signal received from said microprocessor and timed to occur after said second verification is accomplished, all of said plurality of input signals required to be at predetermined signal levels before said enabling logic means can produce said high voltage enabling signal.

6. The arming and firing controller according to claim 5 further comprising first counter verifying logic means and second counter verifying logic means, said first and second counter verifying logic means electrically connected to said counter, said first counter verifying logic means for outputting an initial count verification signal if said counter output count is said first predetermined count after said initial counting period and said second counter verifying logic means for outputting a second count verification signal if said counter output count is said second predetermined count after said second counting period, said second count verification signal being said eighth signal input to said high voltage enabling logic means.

7. The arming and firing controller according to claim 6 wherein said microprocessor produces a first period check signal after said fourth signal has been produced said initial time, and wherein said self-check logic circuit further comprises:

transmitting gate means, electrically connected to said microprocessor and to said first counter verification logic means, for transmitting said initial verification signal upon concurrent receipt of said initial verification signal and said first period check signal; and flip-flop means, electrically connected and responsive to said transmitting gate means, for producing said seventh signal input to said high voltage enabling logic means, said flip-flop means maintaining the signal level of said seventh signal once said seventh signal has been produced.

8. The arming and firing controller according to claim 7 wherein said means for switching the mode of said up-down counter is an AND gate electrically connected to said microprocessor and to said flip-flop means, said AND gate producing a signal changing the mode of said counter in response to concurrent receipt of said seventh signal produced by said flip-flop means and a last period start signal produced by said microprocessor.

9. The arming and firing controller according to claim 6 wherein said first counter verifying gate means is an AND gate and said second counter verifying gate means is a NOR gate.

10. The arming and firing controller according to claim 3 wherein said timed signal generating means includes:

firing signal logic means, electrically connected to said microprocessor and to said firing sensor external to said fuze, for producing said firing signal in response to inputs from said firing sensor and said microprocessor; and, drive signal logic means, electrically connected to said microprocessor, for outputting said drive pulse train produced by said microprocessor when said state of electrical charge of said chargeable storage device is less than a predetermined minimum level of charge and when said microprocessor is producing said drive pulse train.

11. A method of controlling the arming and firing of a munition fuze where said fuze includes an electrically fired warhead detonator and a chargeable electrical energy storage device and, where a firing sensor external to said fuze provides a signal to initiate the detonation of said munition, comprising the steps of:

monitoring the level of electrical charge in said energy storage device;

selecting the mode of operation and timing of operation of said fuze prior to munition employment;

inputting said mode and timing selections into said fuze;

producing a timed sample signal for a predetermined length of time;

producing a clock signal of predetermined frequency;

employing said timed sample signal and said clock signal to cause a counter to count for the length of time during which said timed sample signal is produced;

verifying that the output of said counter is at a predetermined count after said predetermined length of time elapses during which said timed sample signal is produced;

enabling said energy storage device to be electrically charged upon verification of the output of said counter and if said monitoring indicates said storage device requires charging;

arming said fuze by charging said energy storage device;

sensing the presence of a target after fuze arming has occurred; and, firing said warhead detonator upon receipt of said initiation signal from said external firing sensor.

* * * * *